US005752305A

United States Patent [19]

Cotterill et al.

[11] Patent Number: 5,752,305

[45] Date of Patent: May 19, 1998

[54] SELF-PIERCING RIVETING METHOD AND APPARATUS

[75] Inventors: Alf Cotterill, Buckley, United Kingdom; Stuart Edmond Blacket, Brisbane, Australia; Sumanjit Singh, Gamersheim-Lippersthofen, Germany

[73] Assignee: Henrob Limited, United Kingdom

[21] Appl. No.: 454,296

[22] PCT Filed: Dec. 20, 1993

[86] PCT No.: PCT/GB93/02608

§ 371 Date: Mar. 1, 1996

§ 102(e) Date: Mar. 1, 1996

[87] PCT Pub. No.: WO94/14554

PCT Pub. Date: Jul. 7, 1994

[30] Foreign Application Priority Data

Dec. 19, 1992 [GB] United Kingdom ..... 9226517

[51] Int. Cl.[6] ..... B23P 11/00

[52] U.S. Cl. ..... 29/432.2; 29/525.06; 29/243.53; 29/798

[58] Field of Search ..... 29/432.1, 432.2, 29/525.06, 243.53, 798; 227/52, 55, 77

[56] References Cited

U.S. PATENT DOCUMENTS

| | | | |
|---|---|---|---|
| 1,611,876 | 12/1926 | Berger . | |
| 2,465,534 | 3/1949 | Havener | 29/525.06 |
| 4,096,727 | 6/1978 | Gargaillo . | |
| 4,192,058 | 3/1980 | Falcioni . | |
| 4,911,592 | 3/1990 | Muller | 29/432.2 |
| 4,999,896 | 3/1991 | Mangus et al. . | |
| 5,060,362 | 10/1991 | Birke et al. . | |
| 5,277,049 | 1/1994 | Endo | 29/243.53 |

FOREIGN PATENT DOCUMENTS

| | | | |
|---|---|---|---|
| 0 129 358 A3 | 12/1984 | European Pat. Off. . | |
| 0 344 906 A3 | 12/1989 | European Pat. Off. . | |
| 2 350 901 | 12/1977 | France . | |
| 1696081 | 12/1991 | U.S.S.R. | 29/243.53 |
| WO 91/15316 | 10/1991 | WIPO . | |
| WO 93/10925 | 6/1993 | WIPO | 29/432.1 |
| WO 93/24258 | 12/1993 | WIPO . | |

OTHER PUBLICATIONS

Engineering, vol. 222, No. 9, Sep. 1982, London, GB, "Trends in Fastener Design", p. 635, Fig. 3.

*Primary Examiner*—David P. Bryant
*Attorney, Agent, or Firm*—Rudnick & Wolfe

[57] ABSTRACT

A method of riveting comprises inserting a self-piercing rivet into sheet material without full penetration such that the deformed end of the rivet remains encapsulated by an upset annulus of the sheet material. The sheet material is clamped with a substantial force during the riveting operation in the region around the rivet insertion location. The clamping force is maintained constant throughout at least the major part of the riveting operation and has a magnitude of up to 1.5 tonnes. A riveting machine for carrying out the method comprises a punch, means for feeding rivets successively to the punch for insertion into sheet material to be riveted, a die aligned with the punch for deforming the rivet inserted thereby, and clamping means for clamping the sheet material with a substantial force during the riveting operation in the region around the rivet insertion location.

15 Claims, 3 Drawing Sheets

SELF-PIERCING RIVETING METHOD AND APPARATUS

This invention relates to self-piercing riveting and more particularly to a method of and apparatus for riveting of the kind in which a self-piercing rivet is inserted into sheet material without full penetration, such that the deformed end of the rivet remains encapsulated by an upset annulus of the sheet material.

FIG. 1 is a diagrammatic section of an example of a riveted joint made by such a riveting method in accordance with the invention. A rivet 1 has a head 2 and a shank 3 terminating in an annular edge 4. The shank 3 is initially cylindrical but is flared outwardly into the illustrated shape as the rivet is driven into two overlapping sheets 5, 6 located on a suitably shaped die. As shown, the shank 3 and the edge 4 of the rivet remain embedded in the sheet material 5, 6 after the rivet has been set.

Hitherto, riveted joints of the kind illustrated in FIG. 1 have had various imperfections. Desirably, the head 2 of the rivet 1 is flush with the surrounding surface of the sheet 5 which should remain undeformed, and the annular valley 7 between the sheet 5 and the rivet head 2 should be as shallow as possible. In reality, however, the riveting stresses may cause substantial deformation of the upper sheet 5, for example in the form of a circular depression or dimple around the rivet location, and the valley 7 may be unacceptably deep. Although unobjectionable in many applications, such surface distortions are often unacceptable, e.g. for visible joints of motor vehicle body panels, in particular the curved portions of said panels. On the concealed side of the joint, the appearance is immaterial but unevennesses in the thickness of the sheet material 6 encapsulating the rivet end 4 may affect the strength of the joint and permit breakthrough of the rivet end thereby encouraging corrosion.

It will be appreciated that self-piercing riveting is not confined to rivets of the kind shown in FIG. 1. Thus, for example, flat head and pan head style rivets may be used but riveted joints using such alternative rivets have hitherto suffered from at least some of the imperfections mentioned above.

It is an object of the present invention to provide a method of self-piercing riveting of the kind defined in which the aforesaid disadvantages are obviated or mitigated.

The invention also relates to a riveting machine for setting self-piercing rivets in the manner described. A known riveting machine for setting self-piercing rivets is described in U.S. Pat. No. 4,615,475 by Nietek Pty. Ltd. the disclosure of which is incorporated herein by reference.

It is a further object of the present invention to modify the known riveting machine so as to improve the riveted joint produced thereby.

According to a first aspect of the present invention there is provided a method of riveting comprising inserting a self-piercing rivet into sheet material without full penetration such that the deformed end of the rivet remains encapsulated by an upset annulus of the sheet material characterised in that the sheet material is clamped with a substantial force during the riveting operation in the region around the rivet insertion location.

According to a second aspect of the present invention there is provided a riveting machine for inserting a self-piercing rivet into sheet material without full penetration such that the deformed end of the rivet remains encapsulated by an upset annulus of the sheet material, said machine comprising a punch, means for feeding rivets successively to the punch for insertion into sheet material to be riveted, a die aligned with the punch for deforming the rivet inserted thereby, and clamping means for clamping the sheet material with a substantial force during the riveting operation in the region around the rivet insertion location.

The invention will now be further described by way of example only with reference to the accompanying drawings in which.

Figure 3:
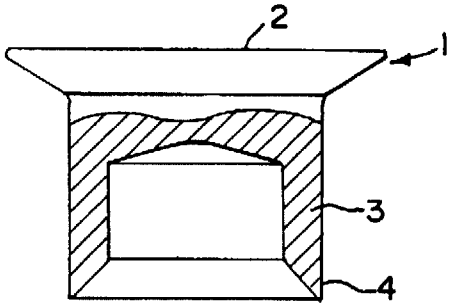
FIG. 3 is a part sectional side elevation of a rivet suitable for use in the riveting method of the invention.
Figure 1:
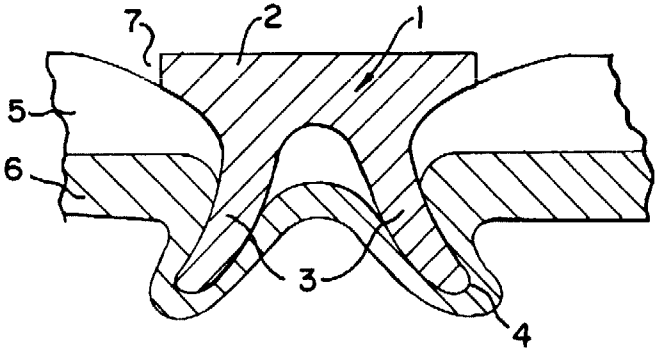
FIG. 1 is a section of a riveted joint made by the riveting method of the invention.

Referring now to the drawings, the riveted joint of FIG. 1 has already been described as an example of the kind of joint that is produced by the riveting method of the invention. The undeformed rivet is shown in FIG. 3 and is given the same reference numerals. It will be noted that the shank 3 is initially cylindrical and the free end 4 has an internal taper to define a cutting edge facilitating insertion and spreading of the rivet.

Figure 2A:
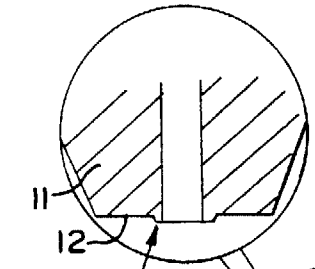
FIG. 2 is a diagram showing the operative components of a riveting machine of the invention at the start of a riveting operation.
Figure 2:
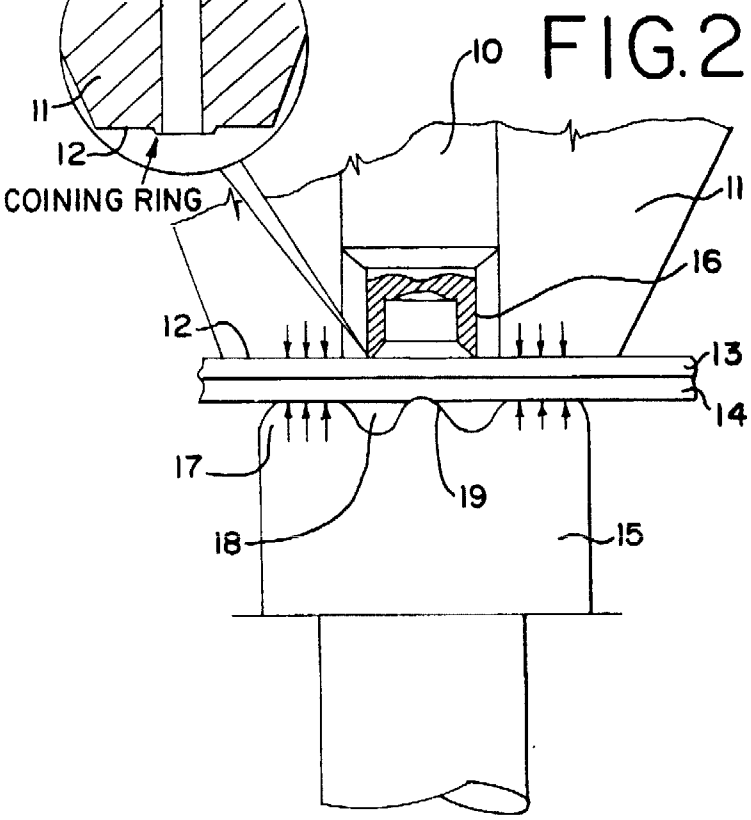

FIG. 2 shows a punch 10 of a riveting tool surrounded by a preclamping element 11 having an annular clamping surface 12 urging two overlapping sheets 13, 14 against a die 15. The surface 12 may have a rough finish provided for example by knurling or annular grooving in order to improve the grip on the sheet material and prevent material being pulled laterally into the joint. A coining ring may be provided on the surface 12 as shown in the inset to FIG. 2. The coining ring functions to prevent material flow and also to regulate distortion adjacent to the rivet head so as to give a uniform appearance. A rivet 16 of the kind shown in FIG. 3 is located at the end of the plunger 10 ready for insertion into the sheets 13, 14. The die 15 has an annular surface 17 (which may be roughened in the same way as the surface 12) cooperating with the clamping surface 12 and surrounding a semi-toroidal cavity 18 around a central projection 19 which is preferably above the level of the clamping surface 17 but may also be below or at the same level as said surface. The clamping element 12 exerts a constant clamping force on the sheets 13, 14. An electronic pressure switch senses the clamping pressure and main riveting process pressure and is used as a control device coordinated by a programmable logic controller. The clamping force, which remains constant during the riveting process, can be accurately set at any value up to approximately 1.5 tonnes. In a hydraulically operated riveting machine the control of the clamping force may involve topping up of the oil in the clamping cylinder to maintain the clamping pressure as the riveting process takes place. This is required because the frame of the riveting machine, which is a C-Frame in the machine shown in U.S. Pat. No. 4,615,475 deflects during the riveting operation and the clamp cylinder must therefore advance to maintain the clamping force constant.

The tapered end 4 of the rivet 1 provides a cutting ring which shears the top sheet 13 with minimal draw of the sheet material as a result of the clamping force. The taper angle on the end of the rivet provides a taper surface which can be thrust radially outwards by the reaction of the die and punch giving reliable spreading of the rivet as it is forced into the die by the punch. The rivet is preferably heat treated to improve its self-piercing quality.

Figure 4:
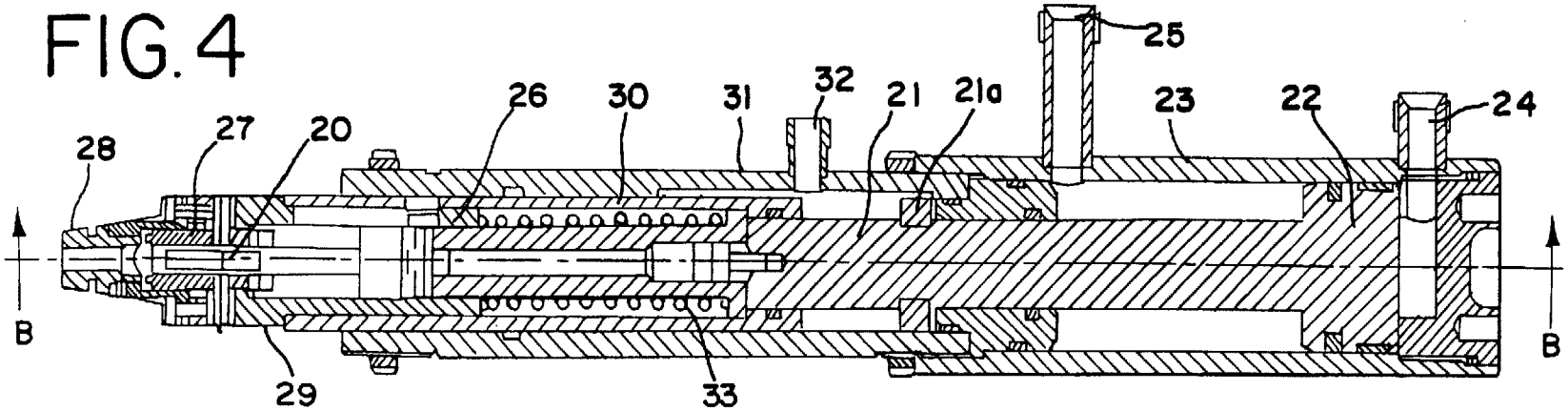
FIGS. 4 and 5 are longitudinal sectional views on mutually perpendicular planes of one embodiment of riveting machine according to the invention.
Figure 5:
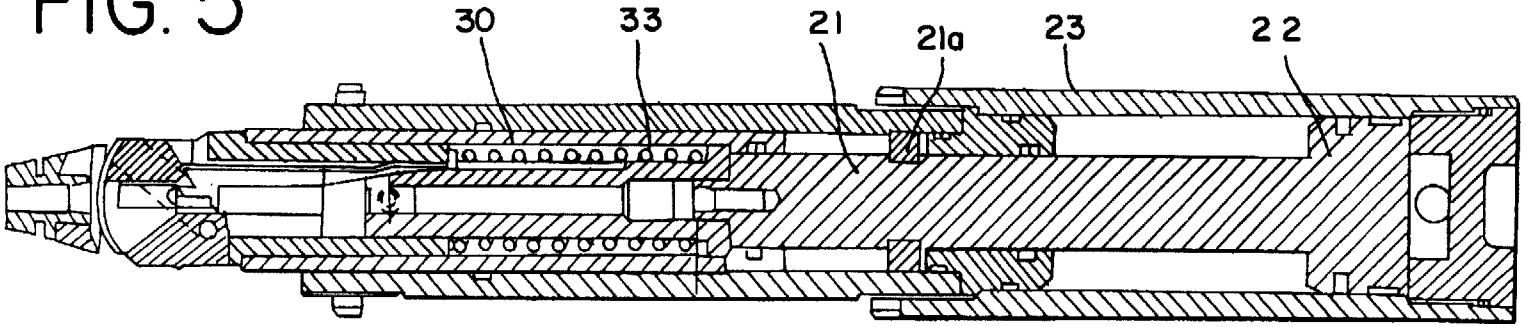

The riveting machine is preferably constructed as shown U.S. Pat. No. 4,615,475. Alternative designs of the clamping and punching part of the machine are shown in FIGS. 4, 5 and FIGS. 6, 7. Referring to FIGS. 4, 5, a punch 20 is carried by a plunger 21 terminating in a double-acting piston 22 slidable in a main cylinder 23 having inlet/outlet connections 24, 25 at opposite sides of the piston 22. The lower part of the plunger 21 (to the left in FIGS. 4 and 5) is slidable in a guide bush 26 which carries an actuator 27 and terminates in a nose 28 the end face of which provides the clamping surface 12 of FIG. 2. The mode of operation of the actuator 27, plunger 21 and punch 20 is fully described U.S. Pat. No. 4,615,475. The machine of FIGS. 4 and 5 differs from that described in U.S. Pat. No. 4,615,475 by virtue of the fact that the head 29 of the guide bush 26 has a shoulder which is engaged by a clamping sleeve 30 which is slidable in a hydraulic cylinder 31 having an inlet/outlet connection 32 for hydraulic fluid.

In use, the nose 28 of the tool is advanced to contact the workpiece by introducing fluid under pressure through the connection 32. A predetermined clamping force is then exerted on the nose 28 by pressurising the cylinder 31 so as to advance the sleeve 30. A constant clamping force is pre-set in the manner already described and the punch 20 is then operated to insert the rivet in the manner fully described in U.S. Pat. No. 4,615,475. Because the central projection 19 of the die 15 (FIG. 2) is above the level of the annular surface 17 of the die 15 the clamping force exerted on the workpiece, i.e. sheets 13, 14, before insertion of the rivet 16 results in pre-indentation of the lower sheet 14 causing improved geometry of material flow during rivet setting.

Figure 6:
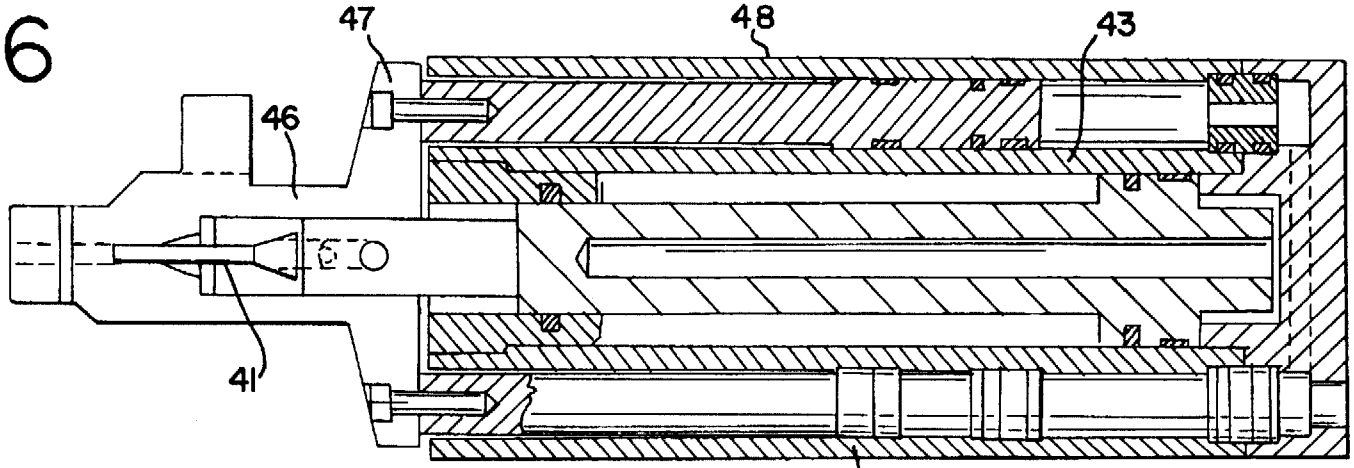
FIGS. 6 and 7 are corresponding views of a second embodiment of riveting machine according to the invention.
Figure 7:
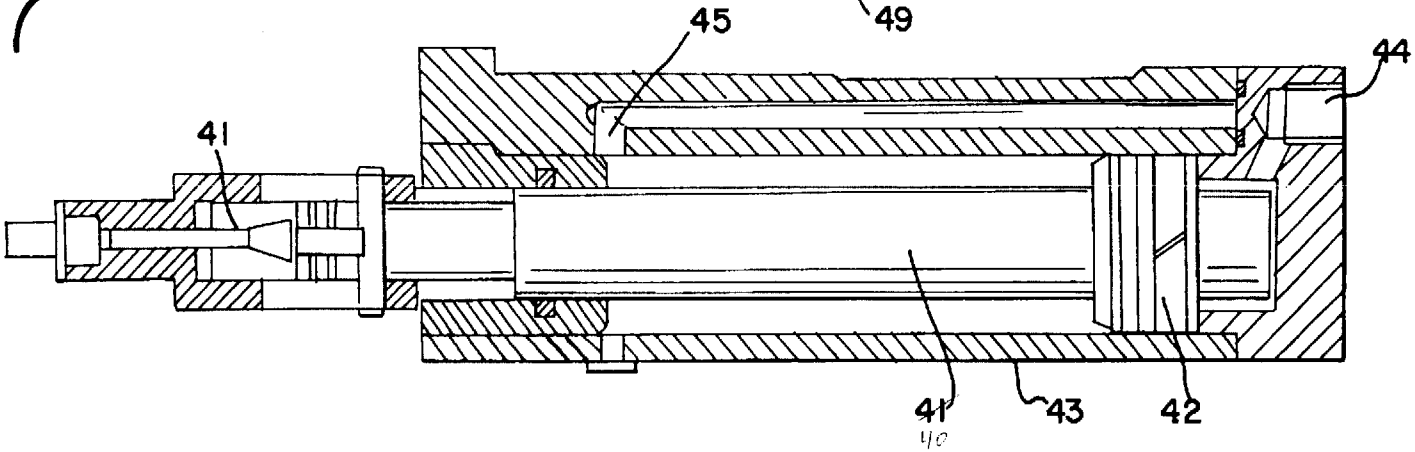

In the more compact design of riveting machine shown in FIGS. 6 and 7, a plunger 40 is connected at one end to a punch 41 and at its other end to a piston 42 slidable in a main cylinder 43 having hydraulic fluid inlets 44, 45 at opposite sides of the piston 42. A guide bush 46 is connected by a cross member 47 to the pistons of a pair of clamping piston-and-cylinder devices 48, 49 flanking the main cylinder 43. In this case, in contrast to the embodiment of FIGS. 4 and 5 and the design shown in U.S. Pat. No. 4,615,475, the rivet feed to the head of the machine is pneumatic rather than mechanical.

The clamping function is identical in both tools—the nose of the tool is advanced forward to contact the work piece and clamp the work between the nose and the die of the riveting tool at a pre-set pressure. Next, the primary hydraulic cylinder operates to set the rivet during which time the pre-clamping is maintained. As the punch retracts by means of the primary cylinder then the clamp cylinder(s) are also retracted. The signal that the pre-clamping operation has occurred is generated by a pressure switch which monitors the clamping pressure. As soon as the pre-set pressure is reached the pressure switch signals the main cylinder to advance for the riveting operation. In the case of the standard stroke tool the forward movement of the clamp pulls forward the plunger and piston of the main hydraulic cylinder. There is no positive pressure on the main hydraulic cylinder as this occurs. On both versions the clamping pressure is maintained by a check valve and the circuit componentry allows for a topping-up of the volume of hydraulic fluid that is maintained under pressure by the check valve. This top-up is to compensate for the small additional advance movement that the clamp components must make in order to maintain pressure on the workpiece as the C-Frame deflects during the riveting process.

A riveted joint may be strengthened by use of an adhesive between adjacent surfaces of the joint, e.g. between the sheets 5, 6 in FIG. 1. The adhesive may be applied in the form of a strip which is then spread evenly over the mating surfaces by application of pressure by means of the pre-clamping mechanism which is adjusted to deliver a low initial pressure for this purpose.

The strength of the riveted joint may be further enhanced by increasing the clamping pressure at the end of the riveting operation. This may be achieved by using the rear (right hand in FIG. 4) end of the clamping sleeve 30 as an abutment for the stop ring 21*a* on the plunger 21 at the end of the riveting stroke. The clamping force is thus momentarily increased e.g. to about 5 tonnes. A similar effect may be achieved by making the coining ring (shown in FIG. 2 as an integral part of the clamping surface 12) a separate component which is urged by suitable actuating means (e.g. mechanical actuating means operated by the plunger mechanism) into its operative position at or towards the end of the riveting operation with an insertion pressure which effectively enhances the clamping pressure acting on the workpiece.

It has been found that clamping of the workpiece, particularly when using a die having a raised central projection for pre-indenting the workpiece, results in greatly improved strength and appearance characteristics of the riveted joint.

We claim:

1. A method of riveting in which first and second superimposed sheets of material are interconnected by driving a self-piercing rivet through the first sheet into non-piercing engagement with the second sheet comprising the steps of:

a) locating a die defining a recess beneath the second sheet in alignment with a punch located above the first sheet;

b) positioning a rivet having an end adapted to expand when driven into a sheet of material between the punch and the first sheet;

c) clamping the sheets together before the rivet is driven into the first sheet with a clamping force applied immediately adjacent the rivet, the clamping force being sufficiently substantial to prevent sheet material from being drawn laterally inwards towards the rivet as the rivet is driven into the sheets; and d) advancing the punch to drive the rivet into the first and second sheets so that the sheets are interconnected.

2. A method as claimed in claim 1, wherein the clamping force is maintained constant throughout at least a major part of the riveting operation.

3. A method as claimed in claims 1 or 2, wherein the clamping force is initially low to assist uniform spread of adhesive in a joint to be riveted.

4. A method as claimed in claims 1 or 2, wherein the die has a semi-toroidal cavity in a die surface against which the second sheet is clamped, the cavity surrounding a central projection extending above said surface for the purpose of pre-indenting the second sheet during initial clamping prior to rivet insertion.

5. A method as claimed in claims 1 or 2, wherein the clamping force is momentarily increased at the end of the riveting operation.

6. A method as claimed in claim 5, wherein the momentary increase in the clamping force is achieved by a coining operation.

7. A method as claimed in claim 6, wherein the die has a semi-toroidal cavity in a die surface against which the second sheet is clamped, the cavity surrounding a central projection extending above said surface for the purpose of pre-indenting the second sheet during initial clamping prior to rivet insertion.

8. A method as claimed in claim 1 or 2, wherein the clamping force has a magnitude of up to 1.5 tonnes.

9. A riveting machine for interconnecting a first sheet of a material and a second sheet of a material by driving a self-piercing rivet through the first sheet into non-piercing engagement with the second sheet comprising:

a) a punch;

b) means for feeding rivets successfully to the punch for insertion into the sheets;

c) a die aligned with the punch for deforming the rivet inserted thereby; and d) clamping means for clamping the sheets during the riveting operation around a location wherein the rivet is inserted, the clamping force being sufficiently substantial to prevent the material of the first sheet from being drawn laterally inwards towards the rivet as the rivet is being driven into the sheets.

10. A machine as claimed in claim 9 wherein the punch is guided in a clamping head having an annular clamping surface coacting with a die surface upon the die to clamp the sheets in use.

11. A machine as claimed in claim 10, wherein said annular clamping surface and the die surface are knurled or otherwise roughened to improve the grip on the sheet material during clamping.

12. A machine as claimed in claim 10 or 11, wherein separate fluid-pressure operated actuating means are provided for exerting a clamping force on the clamping head and for driving the punch in the rivet insertion direction, and the clamp actuating means provides a stop for the punch actuating means so as to cause a momentary increase of the clamping force at the end of the riveting operation.

13. A machine as claimed in claim 10 or 11, wherein a displaceable coining ring has actuating means for carrying out a coining operation at the end of the riveting operation thereby causing a momentary increase of the clamping force at the end of the riveting operation.

14. A machine as claimed in claims 9, 10 or 11, wherein the die has a semi-toroidal cavity in a die surface against which the second sheet is clamped, the cavity surrounding a central projection extending above said surface for the purpose of pre-indenting the second sheet prior to rivet insertion.

15. A machine as claimed in claims 9, 10 or 11, wherein said clamping means includes a fluid-pressure operated means for exerting a clamping force and, further comprising fluid-pressure operated means for driving the punch, wherein said fluid operated means for exerting a clamping force and said fluid-pressure operated means for driving the punch are arranged in side-by-side relationship to reduce the overall length of the machine.

* * * * *

US005752305C1

(12) EX PARTE REEXAMINATION CERTIFICATE (5098th)

United States Patent

Cotterill et al.

(10) Number: US 5,752,305 C1

(45) Certificate Issued: Apr. 19, 2005

(54) SELF-PIERCING RIVETING METHOD AND APPARATUS

(75) Inventors: Alf Cotterill, Buckley (GB); Stuart Edmond Blacket, Brisbane (AU); Sumanjit Singh, Gamersheim-Lippersthofen (DE)

(73) Assignee: Henrob Limited, Clwyd (GB)

Reexamination Request:
No. 90/006,564, Mar. 13, 2003

Reexamination Certificate for:

| | |
|---|---|
| Patent No.: | **5,752,305** |
| Issued: | **May 19, 1998** |
| Appl. No.: | **08/454,296** |
| Filed: | **Mar. 1, 1996** |

(22) PCT Filed: Dec. 20, 1993

(86) PCT No.: PCT/GB93/02608

§ 371 (c)(1), (2), (4) Date: Mar. 1, 1996

(87) PCT Pub. No.: WO94/14554

PCT Pub. Date: Jul. 7, 1994

(30) Foreign Application Priority Data

Dec. 19, 1992 (GB) ..... 9226517

(51) Int. Cl.[7] ..... B23P 11/00

(52) U.S. Cl. ..... 29/432.2; 29/525.06; 29/243.53; 29/798

(58) Field of Search ..... 29/432.2, 525.06, 29/243.53, 798

(56) References Cited

U.S. PATENT DOCUMENTS 1,611,876 A * 12/1926 Berger
2,374,899 A * 5/1945 Sasgen ..... 269/143
3,557,442 A * 1/1971 Speller ..... 29/525.06
3,958,389 A * 5/1976 Whiteside et al.
4,096,727 A * 6/1978 Gargaillo
4,582,238 A * 4/1986 Bennett et al.
4,615,475 A * 10/1986 Fuhrmeister
5,277,049 A * 1/1994 Endo ..... 72/391.4

OTHER PUBLICATIONS

Kenneth Edwards, "Pierce–&–Roll Riveting" Aluminum Industry, The Applications Magazine, Oct./Nov. 1992, vol. 11, No. 5, p. 24–26.*

"Advanced Car Bodies Trigger New Fastening Technology" Sheet Metal Industries, Oct. 1992, p. 14–16.*

English Translation of French Application No. 76 14120, Dec. 1977.*

* cited by examiner

*Primary Examiner*—Eric Compton

(57) ABSTRACT

A method of riveting comprises inserting a self-piercing rivet into sheet material without full penetration such that the deformed end of the rivet remains encapsulated by an upset annulus of the sheet material. The sheet material is clamped with a substantial force during the riveting operation in the region around the rivet insertion location. The clamping force is maintained constant throughout at least the major part of the riveting operation and has a magnitude of up to 1.5 tonnes. A riveting machine for carrying out the method comprises a punch, means for feeding rivets successively to the punch for insertion into sheet material to be riveted, a die aligned with the punch for deforming the rivet inserted thereby, and clamping means for clamping the sheet material with a substantial force during the riveting operation in the region around the rivet insertion location.

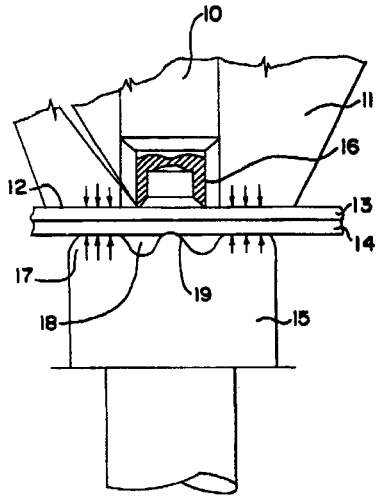

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9–15 is confirmed.

Claim 1 is determined to be patentable as amended.

Claims 2–8, dependent on an amended claim, are determined to be patentable.

New claim 16 is added and determined to be patentable.

1. A method of riveting in which first and second superimposed sheets of material are interconnected by driving a self-piercing rivet through the first sheet into non-piercing engagement with the second sheet comprising the steps of:

a) locating a die defining a recess beneath the second sheet in alignment with a punch located above the first sheet;

b) positioning a rivet having an end adapted to expand when driven into a sheet of material between the punch and the first sheet;

c) clamping the sheets together before the rivet is driven into the first sheet with a clamping force applied immediately adjacent the rivet, the clamping force being [sufficiently substantial] *sufficient* to prevent sheet material from being drawn laterally inwards towards the rivet as the rivet is driven into the sheets, *said clamping force being larger than a clamping force merely required to hold said sheets against each other in a generally non-moving relation*; and d) advancing the punch to drive the rivet into the first and second sheets so that the sheets are interconnected.

*16. A method of riveting in which first and second superimposed sheets of material are interconnected by driving a self-piercing rivet through the first sheet into non-piercing engagement with the second sheet comprising the steps of:*

*a) locating a die defining a recess beneath the second sheet in alignment with a punch located above the first sheet;*

*b) positioning a rivet having an end adapted to expand when driven into a sheet of material between the punch and the first sheet;*

*c) clamping the sheets together before the rivet is driven into the first sheet with a clamping force applied immediately adjacent the rivet, the clamping force being sufficient to prevent sheet material from being drawn laterally inwards towards the rivet as the rivet is driven into the sheets; and*

*d) advancing the punch to drive the rivet into the first and second sheets so that the sheets are interconnected.*

* * * * *